US007507090B2

(12) United States Patent
Herman

(10) Patent No.: US 7,507,090 B2
(45) Date of Patent: Mar. 24, 2009

(54) HEALTH EDUCATION BOARD GAME

(76) Inventor: Sheila Herman, 835 N. Damen, #1F, Chicago, IL (US) 60622

( * ) Notice: Subject to any disclaimer, the term of this patent is extended or adjusted under 35 U.S.C. 154(b) by 473 days.

(21) Appl. No.: 10/596,253

(22) PCT Filed: Dec. 9, 2004

(86) PCT No.: PCT/US2004/041564

§ 371 (c)(1),
(2), (4) Date: Jun. 6, 2006

(87) PCT Pub. No.: WO2005/059865

PCT Pub. Date: Jun. 30, 2005

(65) Prior Publication Data

US 2008/0277870 A1 Nov. 13, 2008

Related U.S. Application Data

(60) Provisional application No. 60/528,800, filed on Dec. 11, 2003.

(51) Int. Cl.
*G09B 19/22* (2006.01)

(52) U.S. Cl. ..... 434/128; 273/236

(58) Field of Classification Search ..... 434/128, 434/129, 262; 273/236, 242, 243, 249, 302, 273/308

See application file for complete search history.

(56) References Cited

U.S. PATENT DOCUMENTS 3,815,919 A * 6/1974 Cain et al. ..... 273/249
4,136,879 A 1/1979 Andrew et al.
4,398,721 A * 8/1983 McKay ..... 273/249
4,440,396 A 4/1984 Frudakis
4,895,374 A * 1/1990 Bowles ..... 273/249
4,991,854 A * 2/1991 Weiss ..... 273/249
5,215,309 A 6/1993 Joel
5,259,623 A * 11/1993 Kanelos, Sr. ..... 273/249
5,350,179 A 9/1994 Hill
5,556,100 A 9/1996 Taylor et al.
5,704,611 A 1/1998 Pierce
5,931,469 A 8/1999 Stichnoth
6,224,056 B1 * 5/2001 Jones ..... 273/249
6,279,908 B1 8/2001 Hunsberger
6,322,076 B1 11/2001 Fikki
6,428,004 B1 8/2002 McQuitty
6,669,196 B1 12/2003 Washko

OTHER PUBLICATIONS

International Search Report of International Application PCT/US2004/041564 filed on Dec. 9, 2004.

* cited by examiner

*Primary Examiner*—Kurt Fernstrom
(74) *Attorney, Agent, or Firm*—Barnes & Thornburg LLP; Glenn W. Ohlson

(57) ABSTRACT

A board game for facilitating health education by involving players in scenarios leading to either "health" or "illness." Players move game pieces along a path (16) between "health" (18) and "illness" (20) by drawing game cards depicting various health-related content specific to the theme of the game, deciding if the scenario relates to health or illness, and then moving the game piece in the appropriate direction to a corresponding color-coded space.

16 Claims, 4 Drawing Sheets

HEALTH EDUCATION BOARD GAME

BACKGROUND

This disclosure relates to a board game for facilitating health education by fostering discussion of health-related issues and providing patients with real-life scenarios to implement and avoid.

Many of the health-related problems that people face stem from unhealthy choices that people make in the course of their daily lives. Consequently, individuals can reduce the risk of contracting any number of diseases and conditions by making appropriate lifestyle choices related to such areas as diet and exercise. However, many individuals, such as those adults with limited education or language ability and children, may not easily understand information regarding the relationship of lifestyle with health. Additionally, many people may fail to realize that the lifestyle choices they make can have either a positive or negative effect on their health.

Because of the complex nature of medical science, health education professionals need to clearly and effectively communicate topics of health education to a diverse audience in a simple and easy-to-understand manner.

Traditional methods of health education may not be appropriate for all individuals. For example, one common method—booklets and pamphlets—requires the patient to possess a fair degree of cognitive ability to process the information. Additionally, the subject matter may be complex or boring to the individual, resulting in failure to comprehend or retain the information provided. Furthermore, other educational methods such as a live lecture or video-taped presentation are "passive," requiring little activity on the part of the individual, leading to the possibility that the individual will retain only a small amount of the information. The obvious result being that the individual makes lifestyle choices that could be detrimental to his or her health.

SUMMARY

This disclosure relates to a board game for facilitating health education. The game is played on surface depicting a path leading in one direction to "health" and in the other direction to "illness." The path is divided into a series of colored spaces corresponding to colors on game cards. Also contained on the cards are lifestyle scenarios depicted with simple pictures and words. The players start in the center and move to the next space on the board corresponding to the color on the card. The direction that the player moves depends on whether the scenario depicted on the card is "healthy"—moving toward health—or "unhealthy"—moving toward illness. The players determine whether the scenario depicted on the card is healthy or unhealthy through discussion with other players and a health education professional.

DETAILED DESCRIPTION

Figure 1:
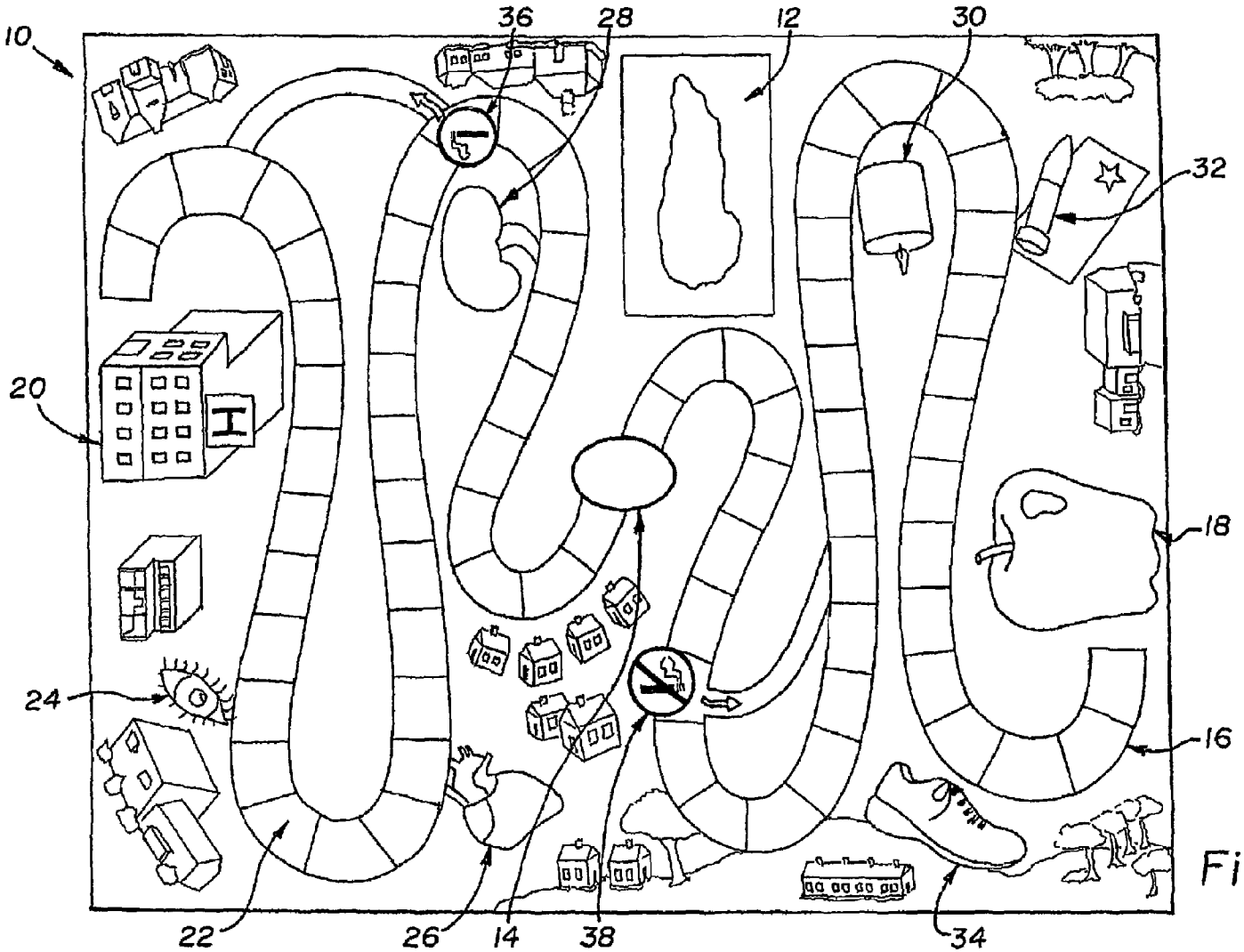
FIG. 1 is a view of one embodiment of the game board laid flat to play.
Figure 2:
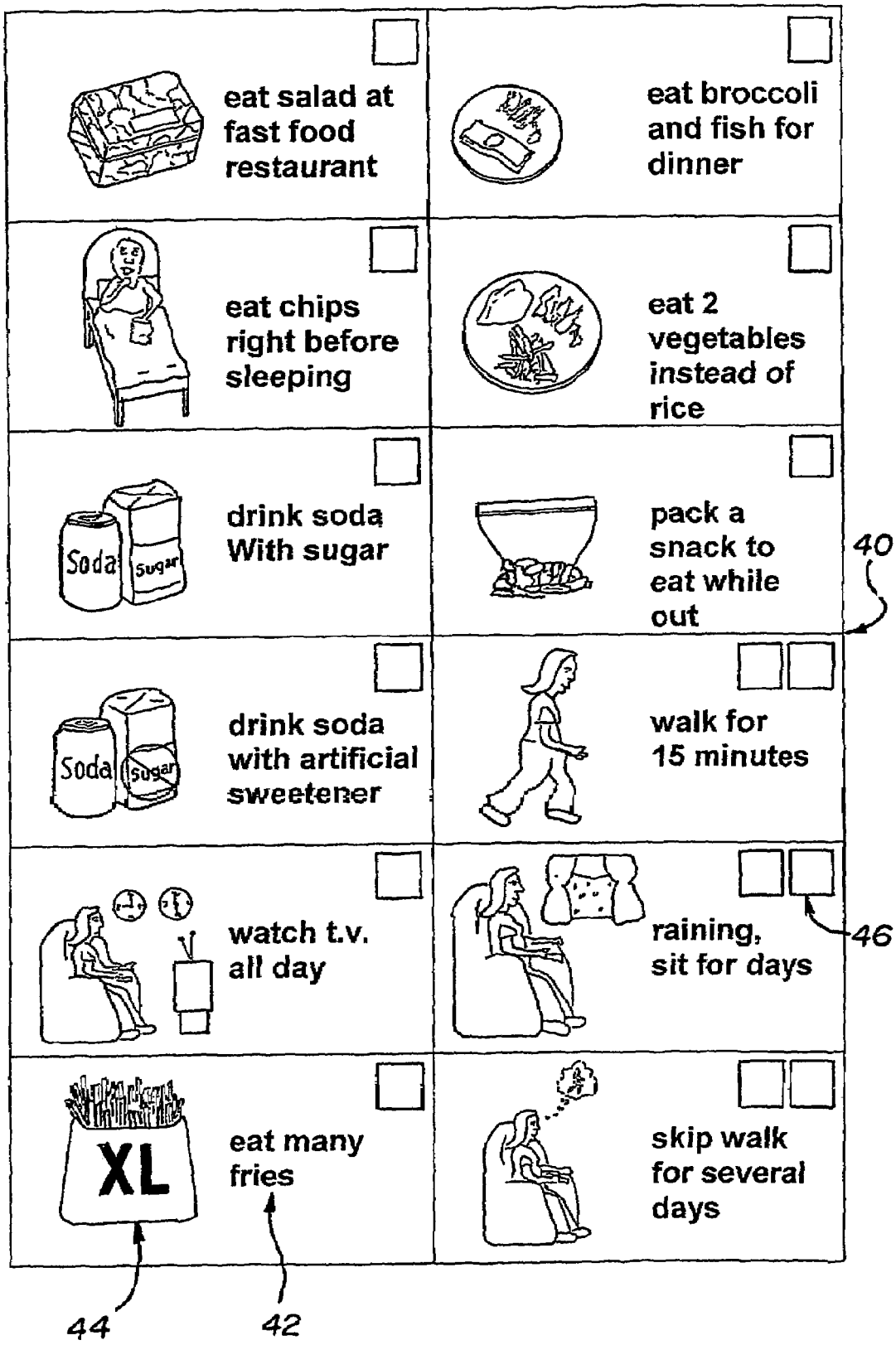
FIG. 2 depicts game cards with scenarios and colored squares for playing the game.
Figure 3:
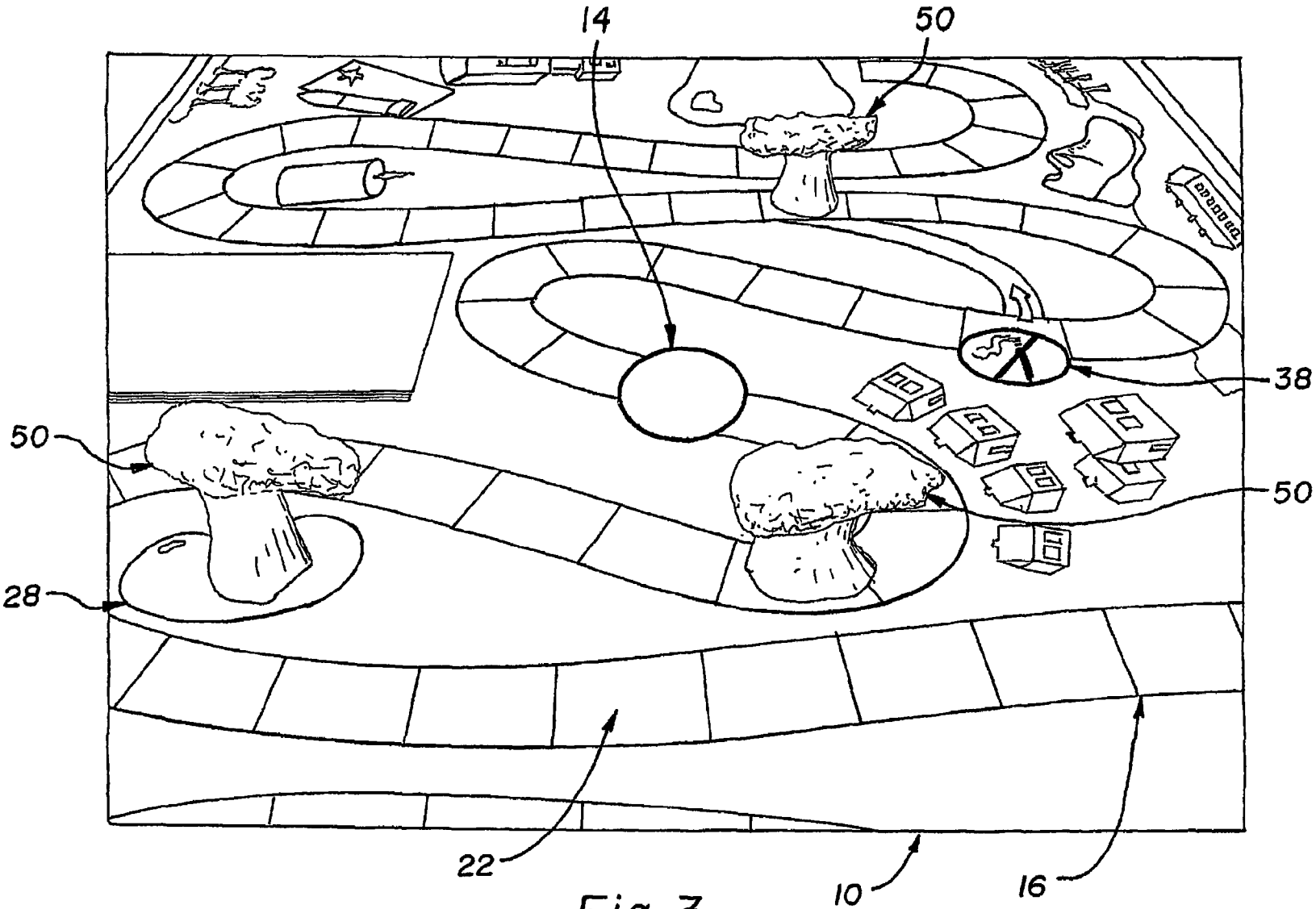
FIG. 3 is a perspective view of the game board with color-coded theme game pieces.
Figure 4:
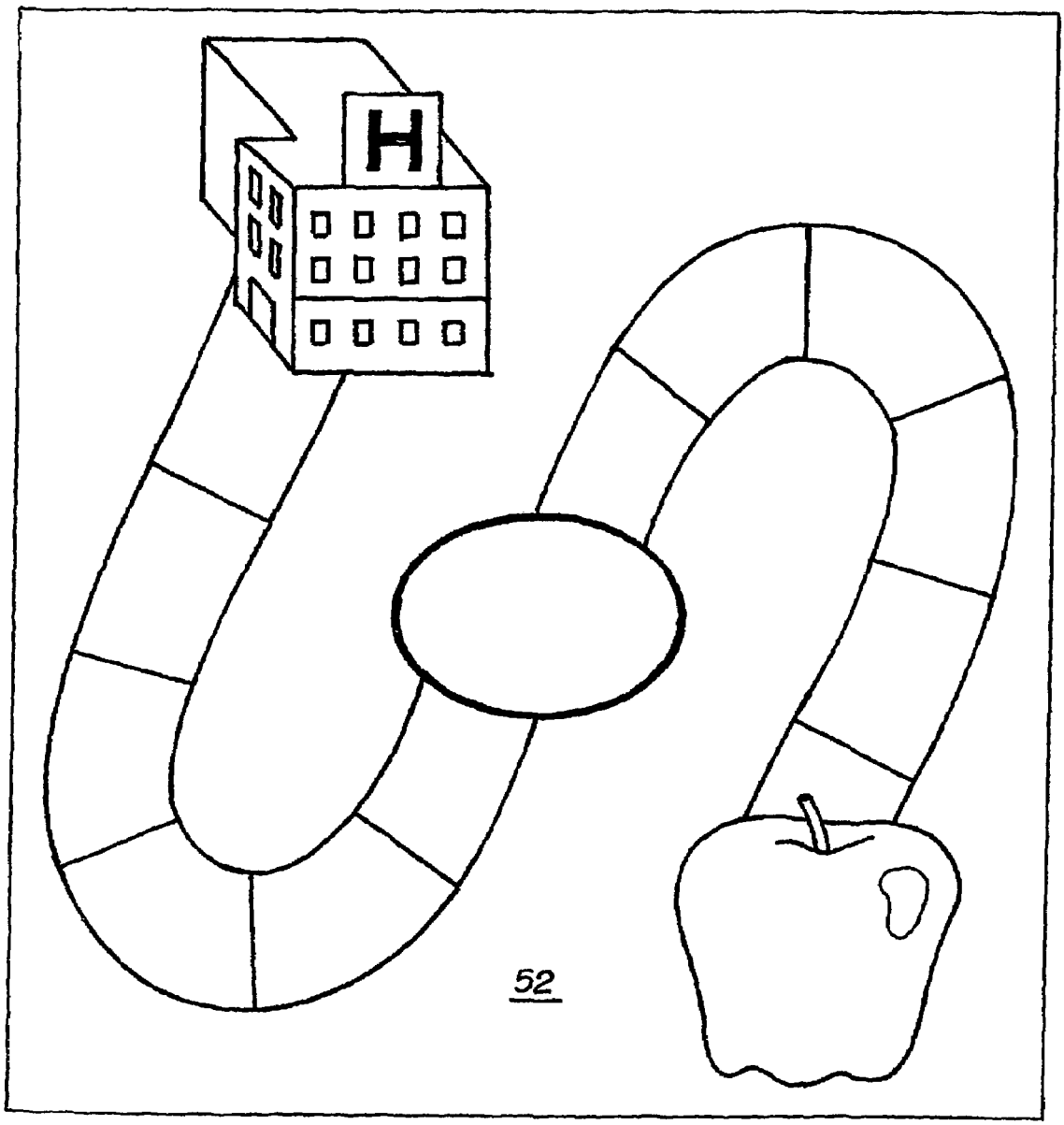
FIG. 4 is an illustration of a "false alarm" card.

The present disclosure relates to a board game for health education. While the theme for the present embodiment is based on diabetes, it is understood that this disclosure is not limited to the present embodiment and that other embodiments having themes such as cardiac care, high cholesterol, cancer prevention, cancer care, obesity, prenatal care, and other health-related topics are included in this disclosure.

These games foster health discussion and give patients real life scenarios to implement and avoid. The objective of the games is for patients to learn connections between certain behaviors and health consequences. The games emphasize the mutability of human health and represent health as a continuum between wellness and sickness. The games are primarily intended for patients (and their caretakers) with a specific health concern. The games are suitable for individuals of all ages as long as the health topic relates. Only minimal reading skills are required, and the games may be translated into different languages.

Before the game begins, each player chooses a game piece (50) and receives a "false-alarm card." Each game has different shaped game pieces depending on the theme of the game. A stack of theme related cards (40) is placed on the game board (10) in the card area (12). To play, each participants places their game piece (50) at the starting area (14) located at the midpoint of the game board's path (16). Then, players take turns picking game cards (40) from the stack on the game board (10). These game cards (40) have large print (42) and corresponding images (44) depicting content associated with the specific theme of the game. The participants, along with a health educator, decide which way along the path the player's piece should move—toward wellness (18) or toward sickness (20)—depending on whether the message of the card is healthy or unhealthy respectively. The game cards have color coded figures (46) that correspond to the colors of the spaces (22) on the path (16) on the game board (10). A player moves to the next colored space corresponding to the number of color coded squares (46), on the game card (40). For example, if a game card has one blue square, the player would move to the next blue space on the path (16); if the game card has two blue squares, the player moves to the second blue space on the path (16); and so forth.

There are some special cards which direct the player to move to some specific spaces (24), (26), (28), (30), (32), (34), on the game board (10). These spaces symbolize either health complications or improved health indicators. Additionally, there are two spaces (36), (38) on the game board (10) symbolizing smoking (36) and quitting smoking (38). When a player lands on the smoking space 36, that player advances past a number of spaces (22) toward sickness (20). In a like manner, if a player lands on the space symbolizing quitting smoking (38), that player advances past a number of spaces (22) toward wellness (18).

Play proceeds from one player to the next, with each player picking a game card (40) and moving in the direction indicated on the card or to a special space. If a player draws a card directing the game piece to move in the direction of illness (20), they have the option of playing a "false-alarm" card (52); this means that they can avoid that unhealthy choice or unfavorable complication in the game. Each player has only one "false alarm" card (52) so it should be played strategically.

The game can be played for a set amount of time or until a set amount of educational content has been discussed. If a player reaches either the area of wellness or sickness, the player does not necessarily remain there, but moves out on the next turn by picking a card that directs movement away from their current location. No one player wins or loses, as the focus of the game is the path and the ability to change one's health situation.

In the present embodiment described herein, the theme of the game is the health condition diabetes, therefore the game pieces (50) are shaped in the form of a pancreas. For a cardiac game the game pieces (50) may be shaped in the form of a heart. Game pieces corresponding to other game themes may be shaped based on the relationship to the health condition that is the subject of the theme.

In the present embodiment, a diabetes game card (40) might say and show with a picture "visit eye doctor" or "eat two slices of pie." The participants, along with a health educator, decide which way along the path the player's game piece should move—toward wellness or toward sickness—depending on whether the scenario of the game card is healthy or unhealthy respectively. The special spaces symbolizing health complications (24), (26), (28), are symbolized in the present embodiment by an eye (24) (retinopathy), a heart (26) (heart attack), and a kidney (28) (kidney failure), while spaces symbolizing improved health indicators (30), (32), (34) are symbolized by a candle (30) start a stress management program, a vial of blood (32) (controlled blood sugar), and a shoe (34) (walking habit). Other symbols may be used for games with other health related themes corresponding to complications or healthy indications related to the particular health condition.

While the concepts of the present disclosure have been illustrated and described in detail in the drawings and foregoing description, such an illustration and description is to be considered as exemplary and not restrictive in character, it being understood that only the illustrative embodiments have been shown and described and that all changes and modifications that come within the spirit of the disclosure are desired to be protected.

There are a plurality of advantages that may be inferred from the present disclosure arising from the various features of the apparatus, systems, and methods described herein. It will be noted that alternative embodiments of each of the apparatus, systems, and methods of the present disclosure may not include all of the features described yet still benefit from at least some of the inferred advantages of such features. Those of ordinary skill in the art may readily devise their own implementations of an apparatus, system, and method that incorporate one or more of the features of the present disclosure and fall within the spirit and scope of the disclosure as defined by the appended claim(s).

What is claimed is:

1. A health-education board game comprising:

a game board having a path between wellness and sickness with color coded spaces and specific spaces representing health complications and improved health indicators, a starting area at the midpoint on the path between wellness and sickness, and a card area;

a plurality of game pieces for marking a player's position on said path; and a plurality game cards, each game card depicting health-related content and having a color-coded figure relating to the color-coded spaces on the game board path, wherein at the beginning of the game, one of said plurality of game pieces is placed in the starting area for each player and said plurality of game cards is placed in a stack in said card area, wherein each player takes turns drawing one of the plurality of game cards, looking at the game card, evaluating whether the game card depicts wellness or sickness, and moving the game piece representing that player to the next colored space on the game board path corresponding to the color-coded figure on the game card.

2. The health-related board game of claim 1 wherein said game cards have large print.

3. The health-related board game of claim 1 wherein said game cards have health-related images.

4. The health-related board game of claim 1 wherein said board game has a theme relating to a specific health-related condition.

5. The health-related board game of claim 4 further comprising:

special spaces on said game board path relating to specific health complications and improved health indicators; and special game cards relating to specific health complications and improved health indicators and corresponding to said special spaces on said game board path.

6. The health related board game of claim 5 wherein said special spaces relating to health complications and improved health indicators correspond to said theme relating to a specific health-related condition.

7. The health-related board game of claim 4 further comprising:

spaces on said game board path representing smoking and quitting smoking, wherein a player landing on said space representing smoking advances additional spaces towards sickness, and conversely a player landing on said space representing quitting smoking advances additional spaces toward wellness.

8. The health-related board game of claim 4 wherein said theme is diabetes.

9. The health-related board game of claim 4 wherein said theme is cardiac care.

10. The health-related board game of claim 4 wherein said theme is high cholesterol.

11. The health-related board game of claim 4 wherein said theme is cancer prevention.

12. The health-related board game of claim 4 wherein said theme is cancer care.

13. The health-related board game of claim 4 wherein said theme is obesity.

14. The health-related board game of claim 4 wherein said theme is prenatal care.

15. A health-education board game comprising:

a game board having a theme related to a specific health-related condition, a path between wellness and sickness with color-coded spaces, special spaces representing health complications and improved health indicators, and spaces representing smoking and quitting smoking, wherein a player landing on said space representing smoking advances additional spaces towards sickness, and conversely a player landing on said space representing quitting smoking advances additional spaces toward wellness, a starting area at the midpoint on the path between wellness and sickness, and a card area;

a plurality of game pieces for marking a player's position on said path;

a plurality of game cards, each game card depicting health-related content, having large print, a health-related image, and a color-coded figure relating to the color-coded spaces on the game board path; and a plurality of special game cards relating to specific health complications and improved health indicators corresponding to said specific spaces on said path, wherein at the beginning of the game, one of said plurality of game pieces is placed in the starting area for each player and said plurality of game cards is placed in a stack in said card area, wherein each player takes turns drawing one of said plurality of game cards, looking at the game card, evaluating whether the game card depicts wellness or sickness, and moving the game piece representing that player to the next colored space on the game board path corresponding to the color-coded figure on the card.

16. A method for playing a health-education board game comprising the steps of:

assembling a plurality of players;

placing a plurality of game pieces within a starting area on a game board, each game piece representing a player, said game board having a path between wellness and sickness with color-coded spaces;

placing a plurality of game cards within a card area on said game board, each of said plurality of game cards having a health-related image and a color coded figure corresponding to said color-coded spaces on said game board; and taking turns for each of said plurality of players, drawing one of said plurality of game cards;

looking at said game card and evaluating whether the health-related image depicts wellness or sickness;

moving said game piece representing said player to next colored-space on said game board path corresponding to the color-coded figure on said game card in the corresponding direction to health-related image on said game card.

* * * * *